US009321255B2

(12) United States Patent
Muraoka

(10) Patent No.: US 9,321,255 B2
(45) Date of Patent: Apr. 26, 2016

(54) PRINTING METHOD

(71) Applicant: SHUHOU CO., LTD., Fukui-shi, Fukui (JP)

(72) Inventor: Kouji Muraoka, Sabae (JP)

(73) Assignee: SHUHOU CO., LTD., Fukui-Shi, Fukui (JP)

( * ) Notice: Subject to any disclaimer, the term of this patent is extended or adjusted under 35 U.S.C. 154(b) by 0 days.

(21) Appl. No.: 14/413,047

(22) PCT Filed: May 23, 2014

(86) PCT No.: PCT/JP2014/063710

§ 371 (c)(1),
(2) Date: Jan. 6, 2015

(87) PCT Pub. No.: WO2014/189131

PCT Pub. Date: Nov. 27, 2014

(65) Prior Publication Data

US 2015/0165754 A1 Jun. 18, 2015

(30) Foreign Application Priority Data

May 23, 2013 (JP) ..... 2013-108620
Sep. 30, 2013 (WO) ..... PCT/JP2013/076573

(51) Int. Cl.
*B41F 3/00* (2006.01)
*B41F 17/34* (2006.01)
*B41M 1/04* (2006.01)

(52) U.S. Cl.
CPC . *B41F 3/00* (2013.01); *B41F 17/34* (2013.01); *B41M 1/04* (2013.01)

(58) Field of Classification Search
CPC . H05K 3/1275; H05K 3/1216; H05K 3/1225; B41F 3/00
IPC ..... H05K 3/1275, 3/1216, 3/1225; B41F 3/00
See application file for complete search history.

(56) References Cited

U.S. PATENT DOCUMENTS 4,779,531 A * 10/1988 Ueno et al. ..... 101/163
2009/0208882 A1* 8/2009 Schmid et al. ..... 430/324
2012/0125215 A1* 5/2012 Cho et al. ..... 101/425

FOREIGN PATENT DOCUMENTS

JP 53-63111 A 6/1978
JP 62-501829 A 7/1987

(Continued)

OTHER PUBLICATIONS

Patent_Abstract_of_JP63128941A.

(Continued)

*Primary Examiner* — David Banh
(74) *Attorney, Agent, or Firm* — Ladas & Parry LLP

(57) ABSTRACT

A printing method wherein when pressing a printing blanket made from an elastic material which becomes thinner towards the tip thereof, is pressed against an original plate for printing, to which ink has been applied, the descending speed is set to a minimum when the tip of the printing blanket comes into contact with the original plate for printing, and as the pressing progresses, the descending speed is increased. Similarly, when the printing blanket is pressed against the surface to be printed, the descending speed is set to a minimum when the tip of the printing bracket comes into contact with the surface to be printed and as the pressing progresses, the descending speed is increased.

10 Claims, 7 Drawing Sheets

(56) References Cited

FOREIGN PATENT DOCUMENTS

| | | | |
|---|---|---|---|
| JP | 63-128941 | A | 6/1988 |
| JP | 11-268497 | A | 10/1999 |
| JP | 2005-212109 | A | 8/2005 |
| JP | 2008-114496 | A | 5/2008 |

OTHER PUBLICATIONS

Patent__Abstract__of__JP11268497A.

Patent__Abstract__of__JPA__2005-212109 A.

Patent__Abstract__of__JPA__2008114496 A.

Office Action dated Sep. 1, 2015 for Japanese Patent Application No. 2014-560581 with English translation.

Office Action dated Nov. 4, 2015 for corresponding Chinese Patent Application No. 201480001625.8 with English translation.

Office Action dated Dec. 14, 2015 for corresponding Taiwanese Patent Application No. 103118029 with English translation.

* cited by examiner (a)

(b)

APPLICATION PROCESS (S1)

TRANSFER PROCESS (S2)

PRINTING PROCESS (S3)

CLEANING PROCESS (S4)

SURFACE ACTIVATION PROCESS (S5)

PRINTING METHOD

RELATED APPLICATION INFORMATION

This application is a 371 of International Application PCT/JP2014/063710 filed 23 May 2014, which was published on 27 Nov. 2014, with International Publication Number WO 2014/189131 A1, and which claims priority from Japanese Patent Application JP 2013-108620 filed 23 May 2013 and JP PCT/JP2013/076573 filed 30 Sep. 2013, the content of which is incorporated herein by reference.

TECHNICAL FIELD

The present invention relates to a printing method, and more particularly to a printing method that employs a printing blanket for printing a printing medium using ink transferred to the printing blanket.

BACKGROUND ART

A conventional printing method that employs a printing blanket includes pressing a printing blanket (transfer blanket) against an original plate (printing plate) to thereby transfer (remove) ink placed on the original plate according to a print pattern to the printing blanket, and pressing the printing blanket to a surface to be printed to deliver the transferred ink to a surface to be printed, thereby printing the print pattern on the surface to be printed. Regarding such a process, a technique has been disclosed that includes causing the original plate to reciprocate to thereby shake and agitate the ink in an ink box disposed in contact with the original plate thereby suppressing the ink from solidifying, in order to prevent degradation of printing quality (see, for example, Patent Literature 1).

CITATION LIST

Patent Literature

Patent Literature 1: Japanese Unexamined Patent Application Publication No. 2008-114496 (pages 9-10, FIG. 1)

SUMMARY OF INVENTION

Technical Problem

Although the technique according to Patent Literature 1 prevents the ink in the ink box from solidifying, this technique has the following drawbacks.

The printing blanket is formed of an elastic material such as silicone rubber containing silicone oil for securing elasticity (flexibility), with an end portion having a semispherical or semicircular column-shaped smooth curved surface (which can be generally regarded as arcuate), and is made to descend and ascend with the end portion (corresponding to the south pole) oriented downward.

Accordingly, in an initial stage of the pressing action of the printing blanket against the original plate, a narrow area of the end portion is brought into contact with the surface of the original plate, and as the printing blanket is pressed further against the original plate the contact area therebetween increases. Likewise, in an initial stage of the pressing action of the printing blanket against the surface of the printing medium, a narrow area of the end portion is brought into contact with the surface of the printing medium, and as the printing blanket is pressed further against the printing medium the contact area therebetween increases.

Therefore, in the initial stage of the pressing action of pressing the printing blanket against the surface of the original plate, a wedge-shaped space of a quite small opening angle between the surface of the end portion of the printing blanket and the surface of the original plate (between the apparent cross-sectional arcuate surface and the flat surface). Likewise, in the initial stage of the pressing action of the printing blanket against the surface of the printing medium, a wedge-shaped space of a quite small opening angle between the surface of the end portion of the printing blanket and the surface of the printing medium.

As the printing blanket is pressed further against the original plate, the end portion of the printing blanket is deformed into a flat shape by being pressed by the surface of the original plate, and an upper portion of the end portion (corresponding to a portion close to the equator) spreads toward the periphery, thus to be deformed such that the apparent curvature radius increases. Accordingly, a curved surface having an even smaller apparent curvature radius is formed between the end portion deformed into the flat shape and the upper portion of the end portion (now located closer to the original plate) deformed such that the apparent curvature radius increases. In other words, a wedge-shaped space having a larger opening angle is formed between the curved surface having the smaller apparent curvature radius and the surface of the original plate.

Likewise, as the printing blanket is pressed further against the printing medium a curved surface having a smaller apparent curvature radius is formed on the printing blanket, and a wedge-shaped space having a larger opening angle is formed between the curved surface having the smaller apparent curvature radius and the surface of the printing medium.

Therefore, when the printing blanket is pressed against the original plate at a constant velocity, in an initial stage of the pressing action the contact area therebetween rapidly increases, and as the printing blanket is pressed further against the original plate the increasing rate of the contact area is reduced. Consequently, the risk that ambient air is caught between the surface of the printing blanket and the surface of the original plate becomes apparent, because of the rapid increase in contact area therebetween in the initial stage of the pressing action, and therefore a part of the print pattern may fail to be transferred to the printing blanket. Likewise, when the printing blanket is pressed against the printing medium at a constant velocity, a part of the print pattern may fail to be transferred to the printing medium.

Further, in the case where the size of the printing blanket is reduced so as to make the curvature radius of the end portion smaller, in order to prevent ambient air from being caught between the surface of the printing blanket and the surface of the original plate or the surface of the printing medium, the height of the printing blanket has to be increased to cover the print pattern, and a softer material has to be employed to form the printing blanket, which leads to an increase in printing cost and degradation in printing efficiency.

Still further, in the case where the velocity to press the printing blanket against the original plate or the printing medium is reduced in order to prevent ambient air from being caught between the surface of the printing blanket and the surface of the original plate or the surface of the printing medium, the printing time is prolonged, which results in degradation in printing efficiency, hence in productivity (mass production efficiency).

The present invention has been accomplished in view of the foregoing problems, and provides a printing method that prevents ambient air from being caught between the surface of the printing blanket and the surface of the original plate or the surface of the printing medium, without incurring an increase in printing cost and degradation in printing efficiency.

Solution to Problem (1) In an aspect, the present invention provides a printing method including pressing a printing blanket against an original plate to which ink is applied, thereby transferring the ink to the printing blanket, the printing blanket being formed of an elastic material and having a shape narrowed toward an end portion, and pressing the printing blanket to which the ink has been transferred against a printing medium thereby printing, with the ink, the printing medium, the method including:

reducing, when pressing the printing blanket against the original plate, a velocity of descending of the printing blanket to a lowest velocity in an initial stage of contact between the end portion of the printing blanket and a surface of the original plate; and increasing the velocity of descending as the printing blanket is pressed further against the original plate.

(2) In the printing method according to (1) above, the reducing the velocity of descending may include setting the velocity of descending of the printing blanket in the initial stage of the contact between the end portion of the printing blanket and the surface of the original plate to 10% to 15% of a velocity of ascending of the printing blanket from the original plate after the pressing of the printing blanket against the original plate is finished, and the increasing the velocity of descending may include setting the velocity of descending to 50% to 60% of the ascending velocity as the printing blanket is pressed further against the original plate.

(3) The printing method according to (1) or (2) above may further include temporarily stopping the descent of the printing blanket when the end portion of the printing blanket contacts the surface of the original plate, and increasing the velocity of descending after the temporary stop.

(4) In another aspect, the present invention provides a printing method including pressing a printing blanket against an original plate to which ink is applied, thereby transferring the ink to the printing blanket, the printing blanket being formed of an elastic material and having a shape narrowed toward an end portion, and pressing the printing blanket to which the ink has been transferred against a printing medium thereby printing, with the ink, the printing medium, the method including:

reducing, when pressing the printing blanket against the printing medium, a velocity of descending of the printing blanket to a lowest velocity in an initial stage of contact between the end portion of the printing blanket and a surface of the printing medium; and increasing the velocity of descending as the printing blanket is pressed further against the printing medium.

(5) In the printing method according to (4) above, the reducing the velocity of descending may include setting the velocity of descending of the printing blanket in the initial stage of the contact between the end portion of the printing blanket and the surface of the printing medium to 10% to 15% of a velocity of ascending of the printing blanket from the printing medium after the pressing of the printing blanket against the printing medium is finished, and the increasing the velocity of descending may include setting the velocity of descending to 50% to 60% of the ascending velocity as the printing blanket is pressed further against the printing medium.

(6) The printing method according to (4) or (5) above may further include temporarily stopping the descent of the printing blanket when the end portion of the printing blanket contacts the surface of the printing medium, and increasing the velocity of descending after the temporary stop.

(7) The printing method according to any one of (1) to (6) above, the printing blanket being configured to start to contact the surface of the printing medium via a portion of the printing blanket other than the end portion instead of starting to contact the surface of the printing medium via the end portion, the method including causing the printing blanket to descend at the lowest velocity in the initial stage of the contact between the portion of the printing blanket other than the end portion and the surface of the printing medium, and increasing the velocity of descending as the printing blanket is pressed further against the printing medium.

(8) In still another aspect, the present invention provides a printing method including pressing a printing blanket against an original plate to which ink is applied, thereby transferring the ink to the printing blanket, the printing blanket being formed of an elastic material and having a shape narrowed toward an end portion, and pressing the printing blanket to which the ink has been transferred against a printing medium thereby printing, with the ink, the printing medium, the method including:

reducing, when pressing the printing blanket against the printing medium, a velocity of descending of the printing blanket when a curvature radius of a predetermined position of a lateral face of the printing blanket becomes close to a curvature radius of a position of the printing medium against which the predetermined position is pressed.

(9) In the printing method according to (8) above, the curvature radius (Rb) of the position of the lateral face of the printing blanket pressed against the printing medium may be larger than a half of the curvature radius (Rp) of the position of the printing medium against which the lateral face of the printing blanket is pressed, and smaller than the curvature radius (Rp) ($Rp/2<Rb<Rp$).

(10) The printing method according to (8) or (9) above may further include reducing the velocity of descending of the printing blanket to 10% to 15% of a velocity of ascending of the printing blanket being separated from the printing medium, and increasing the velocity of descending to 50% to 60% of the velocity of ascending of the printing blanket being separated from the printing medium.

Advantageous Effects of Invention (i) By the printing method according to the present invention, the printing blanket is made to descend at a lowest velocity in the initial stage of the contact between the end portion of the printing blanket and the surface of the original plate, when the printing blanket is pressed against the original plate. Therefore, in the initial stage of the pressing action of the printing blanket against the original plate or the printing medium, a sharp increase in contact area between the surface of the printing blanket and the surface of the original plate or the surface of the printing medium can be suppressed and, consequently, ambient air can be prevented from being caught between the surface of the printing blanket and the surface of the original plate or the surface of the printing medium.

In addition, in the case where the printing blanket is made to descend at a constant low velocity over the entire process in which the end portion of the printing blanket is brought into contact with the original plate or the printing medium, the printing time is prolonged, which results in degradation in printing efficiency and in productivity (mass production efficiency). In contrast, by the printing method according to the present invention the velocity of descending is increased after the initial stage of the contact between the end portion of the printing blanket and the surface of the original plate or the surface of the printing medium, and therefore the increase in printing time can be suppressed, and consequently the degradation in printing efficiency and in productivity (mass production efficiency) can be prevented.

(ii) The velocity of descending in the initial stage of the pressing action is set to approximately ⅙ to ⅓ of the velocity of descending at the time when the pressing is finished, and therefore ambient air can be suppressed from being caught and significant degradation in production efficiency can be prevented.

(iii) The descent of the printing blanket is temporarily stopped when the end portion of the printing blanket is brought into contact with the original plate or the printing medium. Such an arrangement further ensures that ambient air is prevented from being caught between the surface of the printing blanket and the surface of the original plate or the surface of the printing medium.

(iv) Further, the printing blanket is made to descend at the lowest velocity when the portion of the printing blanket other than the end portion starts to contact the surface of the printing medium, and the velocity of descending is increased as the printing blanket is pressed further against the printing medium. Therefore, the same advantageous effects as those provided by (i) above can be attained.

(v) Further, the velocity of descending of the printing blanket is reduced when the curvature radius of a predetermined position on the lateral face of the printing blanket becomes close to the curvature radius of a position on the printing medium against which the predetermined position is pressed. Therefore, the same advantageous effects as those provided by (i) above can be attained, in particular when the surface of the printing medium is uneven.

DESCRIPTION OF EMBODIMENTS

Embodiment 1

Operation Flow

Figure 1:
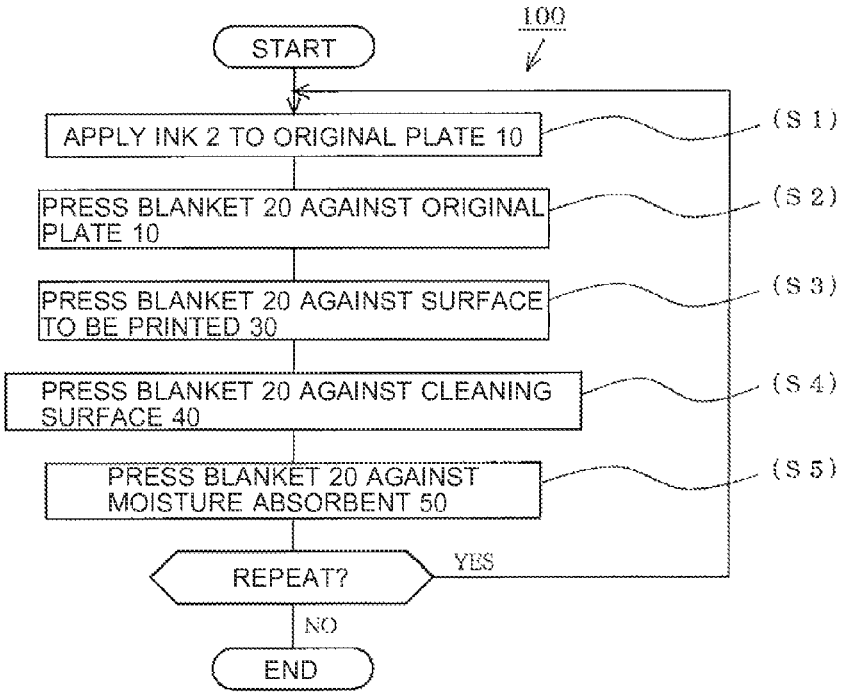
FIGS. 1(*a*) and 1(*b*) are drawings for explaining a printing method according to Embodiment 1 of the present invention, FIG. 1(*a*) being an operation flowchart and FIG. 1(*b*) being a schematic side view showing the operation flow.
Figure 1:
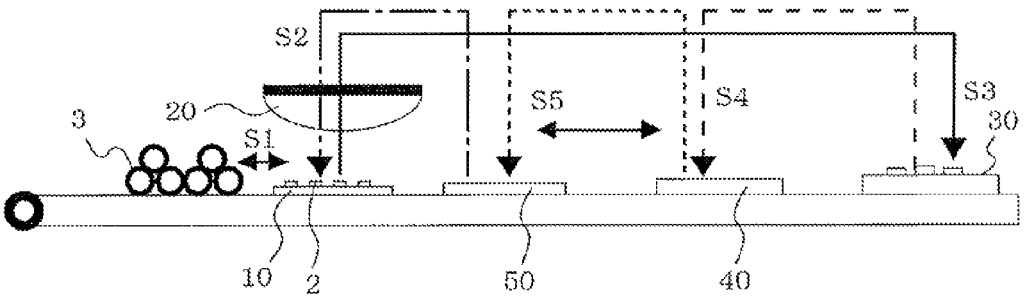

FIG. 1 are drawings for explaining a printing method according to Embodiment 1 of the present invention, FIG. 1(*a*) being an operation flowchart and FIG. 1(*b*) being a schematic side view showing the operation flow.

Figure 2:
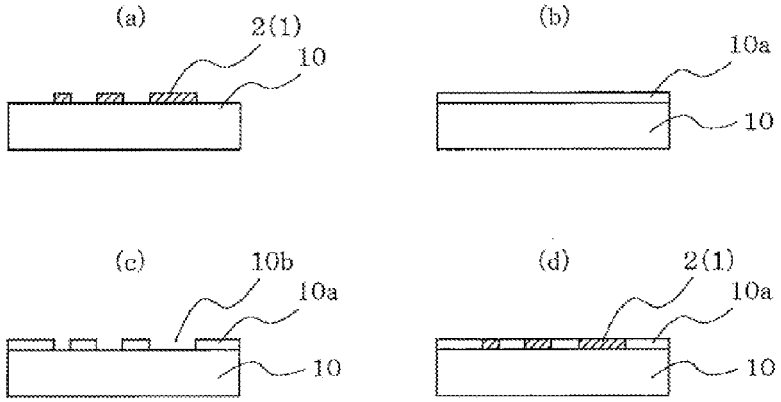
FIGS. 2(*a*) to 2(*d*) are side views showing progress of operation corresponding to the operation flow shown in FIG. 1 (application process).

Referring to FIG. 1 and FIG. 2, the printing method 100 includes an application process (S1) in which ink 2 is applied to an original plate 10 so as to form a predetermined print pattern 1 (see FIG. 2).

a transfer process (S2) in which a printing blanket (hereinafter, simply "blanket") 20 is pressed against the original plate 10 to which the ink 2 has been applied in accordance with the print pattern 1.

a printing process (S3) in which the blanket 20, to which the ink 2 has been transferred is pressed against a surface to be printed 30 (corresponding to the surface of the printing medium), to thereby transfer the ink 2 on the blanket 20 to the surface to be printed 30.

a cleaning process (S4) in which the blanket 20, from which the ink 2 has been transferred to the surface to be printed 30, is pressed against a flat cleaning surface 40, to thereby transfer the residual ink 2 on the blanket 20 to the cleaning surface 40, and a surface activation process (S5) in which the blanket 20, from which the residual ink 2 has been transferred to the cleaning surface 40, is pressed against a moisture absorbent 50, to thereby apply a part of water or solvent impregnated in the moisture absorbent 50% to the blanket 20, or impregnate the blanket 20 with the water or solvent.

After the surface activation process, the blanket 20 having the part of the water or solvent adhering thereto or impregnated therein may be air-blown, to thereby remove the water or solvent adhering thereto or impregnated therein, or the blanket 20 may be pressed against a flat dry surface to thereby remove the water or solvent adhering thereto or impregnated therein.

Figure 3:
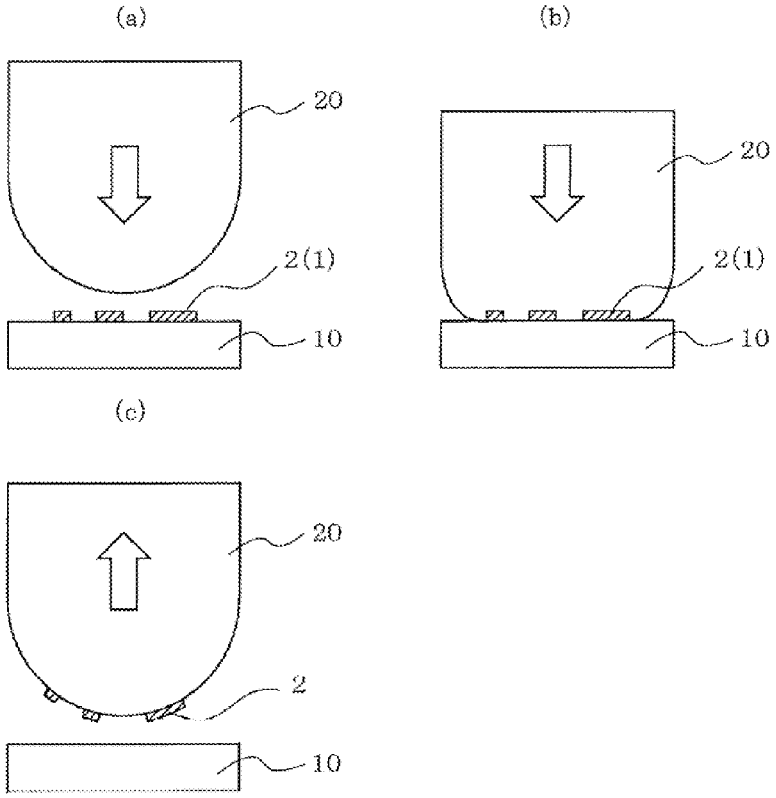
FIGS. 3(*a*) to 3(*c*) are side views showing progress of operation corresponding to the operation flow shown in FIG. 1 (transfer process).
Figure 4:
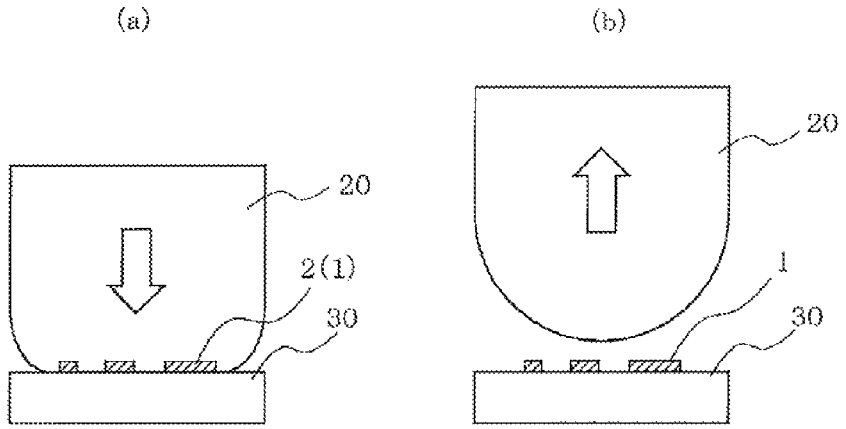
FIGS. 4(*a*) and 4(*b*) are side views showing progress of operation corresponding to the operation flow shown in FIG. 1 (printing process).
Figure 5:
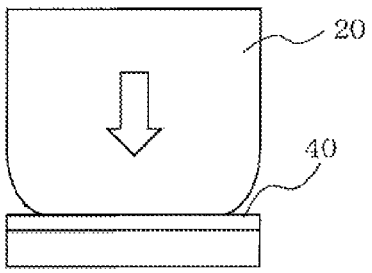
FIG. 5 is a side view showing an operation corresponding to the operation flow shown in FIG. 1 (cleaning process).
Figure 6:
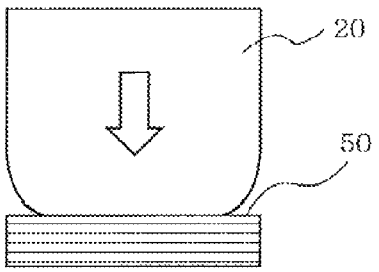
FIG. 6 is a side view showing an operation corresponding to the operation flow shown in FIG. 1 (surface activation process).

FIG. 2 to FIG. 6 are side views showing the progress of operation corresponding to each process of the printing method according to Embodiment 1 of the present invention, FIG. 2 showing the application process, FIG. 3 showing the transfer process, FIG. 4 showing the printing process, FIG. 5 showing the cleaning process, and FIG. 6 showing the surface activation process.

(Application Process)

Referring to FIG. 2(*a*), in the application process (S1) the ink 2 is applied generally over the entire surface of the original plate 10 in a uniform thickness with a roller 3, and the ink 2 applied generally all over is partially removed so that the remaining portion of the ink 2 (indicated by hatched portions of exaggerated film thickness) forms a print pattern 1 (letterpress printing). Alternatively, water may be impregnated in the original plate 10 in accordance with the print pattern 1, so that the water repels a part of the ink 2.

In FIG. 2(*b*), a masking material 10*a* is provided all over the original plate 10, and a recessed portion 10*b* corresponding to the print pattern 1 is formed in the masking material 10*a* in FIG. 2(*c*), and the recessed portion 10*b* is filled with the ink 2 in FIG. 2(*d*) (intaglio printing). Alternatively, a silicone material may be applied to the original plate 10 in accordance with the print pattern 1, so that the silicone material repels a part of the ink 2.

In the application process, the method of applying the ink 2 to the original plate 10 so as to form a predetermined print pattern 1 is not specifically limited, and either of the letterpress printing and the intaglio printing may be employed.

(Transfer Process)

In the transfer process (S2) illustrated in FIGS. 3(*a*) to 3(*c*), the blanket 20 is pressed against the original plate 10 (more precisely, the surface of the original plate 10) to which the ink 2 is adhering in accordance with the print pattern 1, to thereby transfer the ink 2 to the blanket 20. The process of pressing the blanket 20 (velocity of descending) against the original plate 10 will be subsequently described in details.

(Printing Process)

In the printing process (S3) illustrated in FIGS. 4(*a*) and 4(*b*), the blanket 20 to which the ink 2 has been transferred is pressed against the surface to be printed 30, to thereby transfer the ink 2 on the blanket 20 to the surface to be printed 30. Although the surface to be printed 30 is illustrated as a flat surface in FIGS. 4(*a*) and 4(*b*), the surface to be printed 30 may be a non-flat surface (curved surface) without limitation to the flat surface. The process of pressing the blanket 20 (velocity of descending) against the surface to be printed 30 will be subsequently described in details.

(Cleaning Process)

In the cleaning process (S4) illustrated in FIG. 5, the blanket 20 from which the ink 2 has been transferred to the surface to be printed 30 is pressed against the cleaning surface 40 which is flat, to thereby transfer the ink 2 remaining on the blanket 20 to the cleaning surface 40. The material of the cleaning surface 40 is not specifically limited, though it is preferable to employ paper or an adhesive tape.

(Surface Activation Process)

In the surface activation process (S5) illustrated in FIG. 6, the blanket 20 which has undergone the cleaning process is pressed against the moisture absorbent 50, to thereby apply a part of water or solvent impregnated in the moisture absorbent 50 to the blanket 20, or impregnate the blanket 20 with the water or solvent. The moisture absorbent 50 may preferably be composed of approximately fifty stacked paper sheets impregnated with water or solvent, however a different material may be employed provided that the material has moisture absorption capability. In addition, the moisture absorbent 50 may be formed of a single sheet instead of a plurality of stacked sheets.

The solvent may be selected according to the properties of the ink 2 from among the materials capable of softening the ink 2 which is hard, examples of which include, without limitation thereto, thinner, xylene, and toluene.

(Blanket Descending Velocity in Transfer Process)

Figure 7:
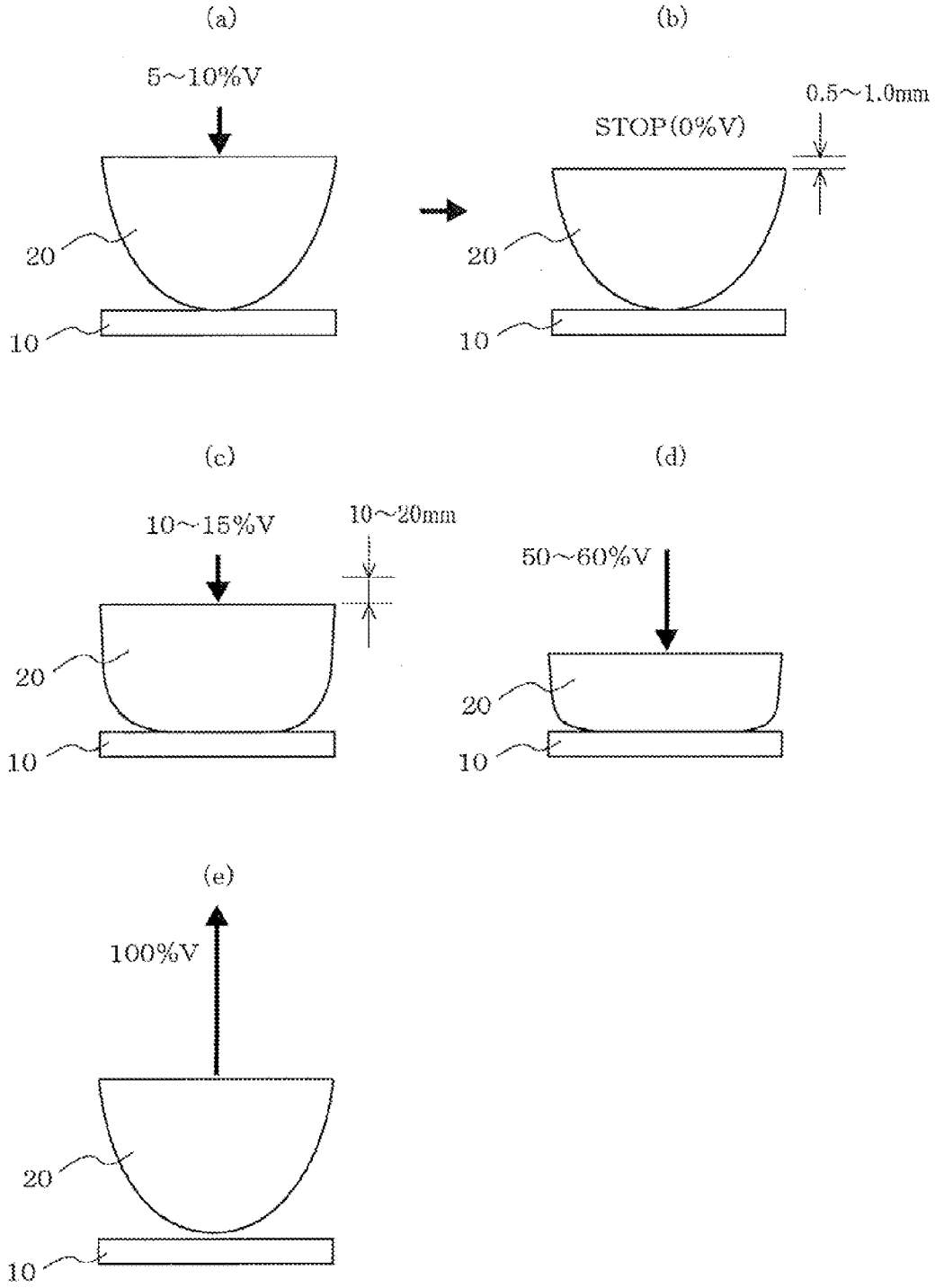
FIGS. 7(*a*) to 7(*e*) are side views for explaining a transfer process in the printing method according to Embodiment 1 of the present invention.

FIG. 7 are side views for explaining the transfer process in the printing method according to Embodiment 1 of the present invention, FIG. 7(*a*) showing start of contact, FIG. 7(*b*) showing a state immediately after the start of contact, FIG. 7(*c*) showing a state in which the contact is in progress, FIG. 7(*d*) showing a state in which the contact is closest, and FIG. 7(*e*) showing separation.

Referring to FIG. 7(*a*), immediately after the start of the transfer process (S2) the blanket 20 is made to descend toward the original plate 10 at a predetermined velocity V, and the velocity of descending of the blanket 20 is reduced (for example, to 10 to 15% of the velocity V) when the blanket 20 starts to contact the original plate 10 (more precisely, immediately before the blanket 20 is brought into contact).

In FIG. 7(*b*), the descent of the blanket 20 is temporarily stopped (for example, 0.5 to 1.0 second), when the blanket 20 is slightly brought into contact with the original plate 10 (for example, when the blanket 20 is pressed against the original plate 10 by approximately 0.5 to 1.0 mm).

In FIG. 7(*c*), the blanket 20 is pressed further against the original plate 10 (for example, by a stroke of 10 to 20 mm) after the temporary stop, while gradually increasing the velocity of descending.

At the time when the pressing of the blanket 20 against the original plate 10 is finished as shown in FIG. 7(*d*), the velocity of descending of the blanket 20 is sufficiently increased (for example, 50 to 60% of the velocity V).

After the pressing of the blanket 20 against the original plate 10 is finished, the blanket 20 is made to ascend thus to be separated from the original plate 10, as shown in FIG. 7(*e*). At this point, the velocity of ascending of the blanket 20 is equal to the velocity V (100% of the velocity V).

Figure 8:
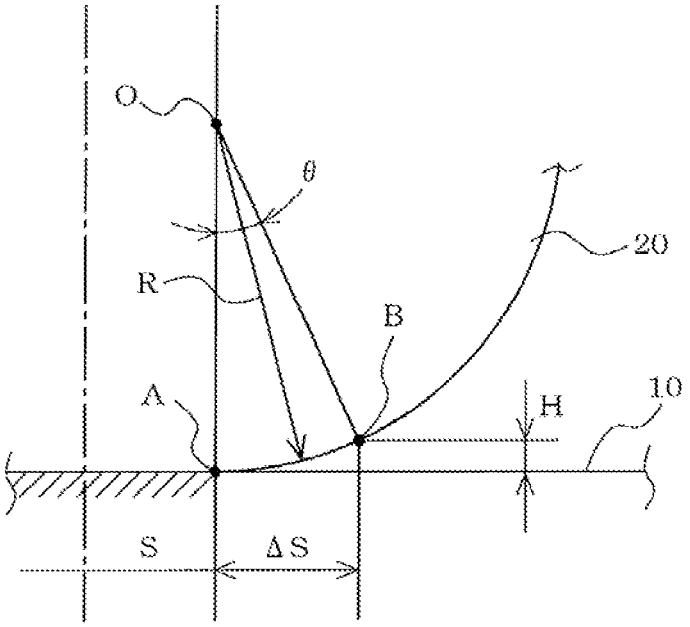
FIG. 8 is a side view for explaining a contact area between a blanket and an original plate, with respect to the transfer process in the printing method according to Embodiment 1 of the present invention.

FIG. 8 is a side view for explaining the contact area between the blanket 20 and the original plate 10, with respect to the transfer process in the printing method according to Embodiment 1 of the present invention.

Referring to FIG. 8, when the blanket 20 descends by a distance H from the position where the blanket 20 is in contact with the original plate 10 via a region S (hatched portion) delimited by a position A on either side, the blanket 20 is brought into contact with the original plate 10 via a contact area (S+ΔS) extended as far as a position B on either side. At this point, the curvature radius of the surface of the blanket 20 between the position A and the position B will be denoted by R (about the center O), and an angle AOB will be denoted by "θ".

On the basis of the above, "$\cos(\theta)=1-H/R$" is established from "$H=R(1-\cos(\theta))$", and an increment ΔS of the contact area can be expressed as "$\Delta S=R\sin(\theta)$". Therefore, upon substituting the former equation for the latter, the increment ΔS can be expressed as "$\Delta S=\sqrt{(2HR-H^2)}$". Since R is by far larger than H with respect to a short period of time, the increment ΔS of the contact area may be regarded as approximately equal to "$\sqrt{(2HR)}$".

Now, by the printing method 100 according to the present invention, while the curvature radius of the blanket 20 (more precisely, the curvature radius of the cross-section approximately regarded as an arc) is sufficiently large at the moment of contact and immediately after the contact, the velocity of descending is made slower. Accordingly, the distance H per unit time in the equation cited above is reduced, and therefore the increment ΔS of the contact area per unit time is reduced.

As a result, a time for ambient air to escape from the wedge-shaped space defined between the surface of the blanket 20 and the surface of the original plate is secured at the moment of contact and immediately after the contact, and therefore the ambient air can be prevented from being caught between the surface of the blanket 20 and the surface of the original plate.

The mentioned method eliminates the need to make the printing blanket smaller, reduce the curvature radius of the end portion, increase the height, and employing a softer material, all of which lead to an increase in printing cost and degradation in printing efficiency. Therefore, a high-quality printed product can be obtained at a lower cost.

When the contact is made over a larger area and the curvature radius of the blanket 20 (more precisely, the curvature radius of the cross-section approximately regarded as an arc) decreases, the velocity of descending is increased. Accordingly, the distance H per unit time in the equation cited above is increased and therefore the increment ΔS of the contact area per unit time does not largely vary. Consequently, the ambient air can be prevented from being caught between the surface of the blanket 20 and the surface of the original plate, despite the velocity of descending being increased.

Further, since the velocity of descending is increased when the contact is made over a larger area, the printing time is prevented from being prolonged compared with the case of reducing the velocity of descending throughout the contacting process. Therefore, degradation in printing efficiency and in productivity (mass production efficiency) can be suppressed.

The level (extent of reduction) of the velocity of descending at the moment of the contact, the level (extent of increase) of the velocity of descending after the contact, and the timing and method (whether gradually or stepwise) of changing the velocity of descending are not specifically limited. In addition, the velocity of descending V for making the contact and the ascending velocity for separating the blanket 20 from the original plate 10 after the contact is finished may be different from each other.

Further, although the descent of the blanket 20 is temporarily stopped when the contact is slightly made in Embodiment 1, the temporary stop may be skipped, without limitation to the above.

(Blanket Descending Velocity in Printing Process)

In the printing process (S3) also, the velocity of descending of the blanket 20 is reduced when the blanket 20 starts to contact the surface to be printed 30 as in the transfer process (S2), because ambient air may be caught as in the transfer process (S2). Then when the blanket 20 slightly contacts the surface to be printed 30, the descent of the blanket 20 is temporarily stopped. After the temporary stop, the blanket 20 is pressed further against the surface to be printed 30 while gradually increasing the velocity of descending.

Accordingly, ambient air can be prevented from being caught between the surface of the blanket 20 and the surface of the surface to be printed 30 as in the transfer process (S2), and therefore degradation in printing efficiency and in productivity (mass production efficiency) can be suppressed.

Embodiment 2

Blanket Descending Velocity in Printing Process

Figure 9:
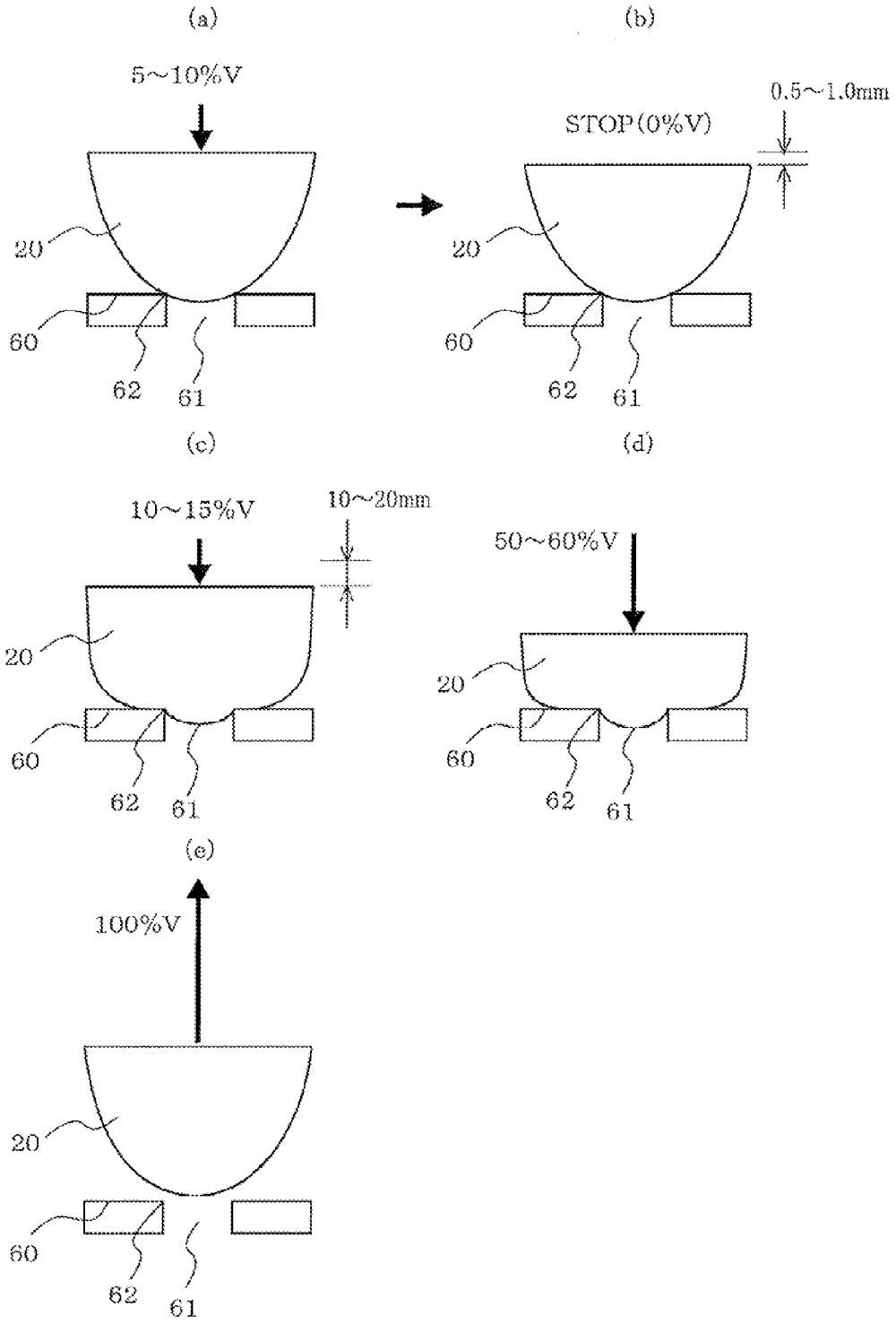
FIGS. 9(*a*) to 9(*e*) are side views showing a printing process for explaining a printing method according to Embodiment 2 of the present invention.

FIGS. 9(*a*) to 9(*e*) are side views showing a printing process for explaining a printing method according to Embodiment 2 of the present invention, FIG. 9(*a*) showing the moment of contact, FIG. 9(*b*) showing the state immediately after the start of contact, FIG. 9(*c*) showing a state in which the contact is in progress, FIG. 9(*d*) showing a state in which the contact is closest, and FIG. 9(*e*) showing the separation. The same constituents as those of Embodiment 1 will be given the same numeral, and the description thereof will not be repeated. The printing method 200 according to the present invention will be described hereunder on the assumption that the surface to be printed is formed with a hole of a circular shape in a cross-sectional view. However, the present invention is not limited to such a configuration but the surface to be printed may include a bottomed hole, in other words a recessed portion, and the cross-sectional shape thereof may be other than circular.

Referring to FIG. 9(*a*), a circular hole 61 is formed in a surface to be printed 60, and the boundary between the surface to be printed 60 and the hole 61 will be referred to as hole periphery 62. Immediately after the start of the printing process (S32) the blanket 20 is made to descend toward the surface to be printed 60 at a predetermined velocity V, and the velocity of descending of the blanket 20 is reduced (for example, to 10 to 15% of the velocity V) when the blanket 20 starts to contact the surface to be printed 60 (more precisely, immediately before the blanket 20 is brought into contact).

In FIG. 9(*b*), the descent of the blanket 20 is temporarily stopped (for example, 0.5 to 1.0 second), when the blanket 20 is slightly brought into contact with the hole periphery 62 of the surface to be printed 60 (for example, when the blanket 20 is pressed against the surface to be printed 60 by approximately 0.5 to 1.0 mm).

In FIG. 9(*c*), the blanket 20 is pressed further against the surface to be printed 60 (for example, by a stroke of 10 to 20 mm) after the temporary stop, while gradually increasing the velocity of descending.

At the time when the pressing of the blanket 20 against the surface to be printed 60 is finished as shown in FIG. 9(*d*), the velocity of descending of the blanket 20 is sufficiently increased (for example, 50 to 60% of the velocity V).

After the pressing of the blanket 20 against the surface to be printed 60 is finished, the blanket 20 is made to ascend thus to be separated from the surface to be printed 60, as shown in FIG. 9(*e*). At this point, the velocity of ascending of the blanket 20 is equal to the velocity V (100% of the velocity V).

Thus, by the printing method 200 according to the present invention, the velocity of descending is made slower at the moment that the blanket 20 starts to contact the hole periphery 62 of the surface to be printed 60 and immediately after the contact, and therefore the increment ΔS of the contact area per unit time is reduced. As a result, a time for ambient aft to escape from the wedge-shaped space defined between the surface of the blanket 20 and the surface to be printed 60 is secured at the moment of contact and immediately after the contact, and therefore the ambient air can be prevented from being caught between the surface of the blanket 20 and the surface to be printed 60. Therefore, a high-quality printed product can be obtained at a lower cost, as in Embodiment 1.

In contrast, when the contact is made over a larger area and the curvature radius of the blanket 20 (more precisely, the curvature radius of the cross-section approximately regarded as an arc) decreases, the ambient air can be prevented from being caught between the surface of the blanket 20 and the surface to be printed 60, despite the velocity of descending being increased. Therefore, degradation in printing efficiency and in productivity (mass production efficiency) can be suppressed, as in Embodiment 1.

Embodiment 3

Blanket Descending Velocity in Printing Process

Figure 10:
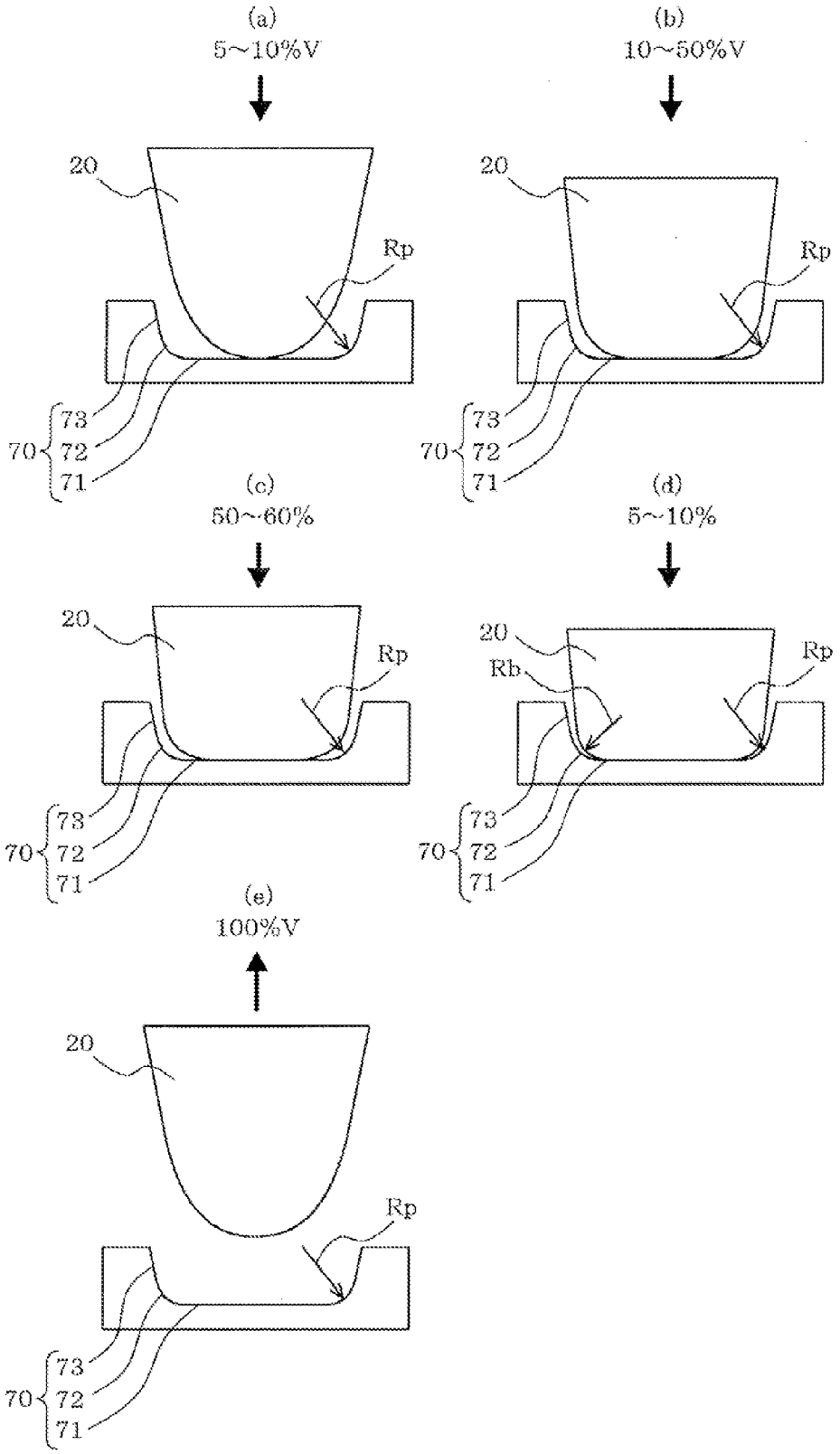
FIGS. 10(*a*) to 10(*e*) are side views showing a printing process for explaining a printing method according to Embodiment 3 of the present invention.

FIG. 10 are side views showing a printing process for explaining a printing method according to Embodiment 3 of the present invention, FIG. 10(*a*) showing the state immediately after the start of contact, FIGS. 10(*b*) and 10(*c*) showing a state in which the contact is in progress, FIG. 10(*d*) showing a state immediately before a closest contact, and FIG. 10(*e*) showing the separation. The same constituents as those of Embodiment 1 will be given the same numeral, and the description thereof will not be repeated. The printing method 300 according to the present invention will be described hereunder on the assumption that the surface to be printed includes an annular protruding portion having smooth outskirts. However, the present invention is not limited to such a configuration, but the surface to be printed may include discontinuous projections or a linear rib, the number and the layout of which (whether symmetric or asymmetric, in the case of plurality) may be determined as desired.

Referring to FIG. 10(*a*), the surface to be printed 70 includes a flat portion 71 and an annular protruding portion 73, which are connected via a corner portion 72 having an arcuate cross-sectional shape. For the sake of convenience of the description, the curvature radius of the cross-section of the corner portion 72 will be denoted by "Rp".

Immediately after the start of the printing process (S3), the blanket 20 is made to descend toward the surface to be printed 70 at a predetermined velocity V, and the velocity of descending of the blanket 20 is reduced (for example, to 10% to 15% of the velocity V) when the blanket 20 starts to contact the flat portion 71 of the surface to be printed 70 (more precisely, immediately before the blanket 20 is brought into contact). Then the descent of the blanket 20 is temporarily stopped (for example, 0.5% to 1.0 second, though not shown) when the blanket 20 is slightly brought into contact with the flat portion 71 of the surface to be printed 70 (for example, when the blanket 20 is pressed against the surface to be printed 70 by approximately 0.5% to 1.0 mm).

In FIG. 10(*b*), the blanket 20 is pressed further against the flat portion 71 of the surface to be printed 70 (for example, by a stroke of 10 to 20 mm) after the temporary stop, while gradually increasing the velocity of descending.

In FIG. 10(*c*), the velocity of descending of the blanket 20 is sufficiently increased (for example, 50 to 60% of the velocity V), until immediately before the blanket 20 reaches the corner portion 72 of the surface to be printed 70.

When the blanket 20 comes close to the corner portion 72 of the surface to be printed 70 as shown in FIG. 10(*d*), the velocity of descending of the blanket 20 is reduced, and when the lateral face of the blanket 20 is abutted against the corner portion 72 the velocity of descending of the blanket 20 is reduced to a level similar to the velocity at the start of the contact (for example, 5 to 10% of the velocity V). Thereafter, the lateral face of the blanket 20 is pressed against the protruding portion 73 of the surface to be printed 70, at the same reduced velocity (not shown).

Here, a curvature radius Rb, representing the curvature radius of the cross-section of the portion of the blanket 20 pressed against the corner portion 72, is larger than a half of the curvature radius Rp of the cross-section of the corner portion 72, but smaller than the curvature radius Rp ($Rp/2<Rb<Rp$).

After the pressing of the blanket 20 against the surface to be printed 70 is finished, the blanket 20 is made to ascend thus to be separated from the surface to be printed 70, as shown in FIG. 10(*e*). At this point, the velocity of ascending of the blanket 20 is equal to the velocity V (100% of the velocity V).

Thus, by the printing method 300 according to the present invention, the velocity of descending is made slower at the moment that the blanket 20 starts to contact the flat portion 71 of the surface to be printed 70 and immediately after the contact, but then made faster until the blanket 20 comes close to the corner portion 72, at which point the velocity of descending is again reduced, and when the blanket 20 is pressed against the corner portion 72 the velocity of descending is reduced to a lowest level. Accordingly, the increment ΔS (not shown) of the contact area per unit time is reduced, and therefore a time for ambient air to escape from the wedge-shaped space defined between the surface of the blanket 20 and the surface to be printed 70 (flat portion 71, corner portion 72, and protruding portion 73) is secured. As a result, the ambient air can be prevented from being caught between the surface of the blanket 20 and the surface to be printed 70. Therefore, a high-quality printed product can be obtained at a lower cost, as in Embodiment 1.

In contrast, while the surface of the blanket 20 is pressed against the flat portion 71, the ambient air can be prevented from being caught between the surface of the blanket 20 and the surface to be printed 70, despite the velocity of descending being increased, and therefore degradation in printing efficiency and in productivity (mass production efficiency) can be suppressed, as in Embodiment 1.

INDUSTRIAL APPLICABILITY

The present invention prevents ambient air from being caught between the surface of the blanket and the surface of the original plate, as well as between the surface of the blanket and the surface of the printing medium, and is therefore broadly applicable to printing processes that employ various types (shape, size, material, and so forth) of blankets.

REFERENCE SIGNS LIST

1: print pattern, 2: ink, 3: roller, 10: original plate, 10*a*: masking material, 10*b*: recessed portion, 20: printing blanket (blanket), 30: surface to be printed, 40: cleaning surface, 50: moisture absorbent, 60: surface to be printed, 61: hole, 62: hole periphery, 70: surface to be printed, 71: flat portion, 72: corner portion, 73: protruding portion, 100: printing method, 200: printing method, 300: printing method

The invention claimed is:

1. A printing method comprising the steps of:

pressing a printing blanket against an original plate to which ink is applied, wherein the printing blanket is formed of an elastic material and has a shape having a flat top surface and narrowed toward an end portion on a bottom surface, transferring the ink to the printing blanket, and pressing the printing blanket to which the ink has been transferred against a printing medium thereby printing, with the ink, the printing medium, wherein the step of transferring the ink includes:

pressing the printing blanket against the original plate, reducing a velocity of descent of the top surface of the printing blanket to a lowest velocity in an initial stage of contact between the end portion of the printing blanket and a surface of the original plate; and increasing the velocity of descent of the top surface of the printing blanket as the printing blanket is pressed further against the original plate after the initial stage of contact between the end portion of the printing blanket and the surface of the original plate.

2. The printing method of claim 1, wherein the reducing the velocity of descent includes setting the velocity of descent of the printing blanket in the initial stage of the contact between the end portion of the printing blanket and the surface of the original plate to 10% to 15% of a velocity of ascent of the printing blanket being separated from the original plate after the pressing of the printing blanket against the original plate is finished, and the increasing the velocity of descent includes setting the velocity of descent to 50% to 60% of the ascent velocity as the printing blanket is pressed further against the original plate.

3. The printing method of claim 1, further comprising temporarily stopping the descent of the printing blanket when the end portion of the printing blanket contacts the surface of the original plate; and increasing the velocity of descent after the temporary stop.

4. A printing method comprising the steps of:

pressing a printing blanket against an original plate to which ink is applied, wherein the printing blanket is formed of an elastic material and has a shape having a flat top surface and narrowed toward an en portion on a bottom surface, transferring the ink to the printing blanket, and pressing the printing blanket to which the ink has been transferred against a printing medium thereby printing, with the ink, the printing medium, wherein the step of transferring the ink includes:

pressing the printing blanket against the printing medium, reducing, a velocity of descent of the top surface of the printing blanket to a lowest velocity in an initial stage of contact between the end portion of the printing blanket and a surface of the printing medium; and increasing the velocity of descent of the top surface of the printing blanket as the printing blanket is pressed further against the printing medium after the initial stage of contact between the end portion of the printing blanket and the surface of the printing medium.

5. The printing method of claim 4, wherein the reducing the velocity of descent includes setting the velocity of descent of the printing blanket in the initial stage of the contact between the end portion of the printing blanket and the surface of the printing medium to 10% to 15% of a velocity of ascent of the printing blanket being separated from the printing medium after the pressing of the printing blanket against the printing medium is finished, and the increasing the velocity of descent includes setting the velocity of descent to 50% to 60% of the ascent velocity as the printing blanket is pressed further against the printing medium.

6. The printing method of claim 4, further comprising temporarily stopping the descent of the printing blanket when the end portion of the printing blanket contacts the surface of the printing medium; and increasing the velocity of descent after the temporary stop.

7. A printing method comprising the steps of:

pressing a printing blanket against an original plate to which ink is applied, wherein the printing blanket is formed of an elastic material and has a shape having a flat top surface and narrowed toward an end portion on a bottom surface, transferring the ink to the printing blanket, and pressing the printing blanket to which the ink has been transferred against a printing medium thereby printing, with the ink, the printing medium, the printing medium including a printing surface opposing the printing blanket and a hole formed on the printing medium at a position opposing the end portion of the printing blanket, wherein the step of transferring the ink includes:

causing the top of the printing blanket to descend at a lowest velocity in an initial stage of contact between the printing blanket and the periphery of the hole, and increasing the velocity of descent of the top surface of the printing blanket as the printing blanket is pressed further against the printing medium after the initial stage of contact between the end portion of the printing blanket and the periphery of the hole.

8. A printing method comprising the steps of:

pressing a printing blanket against an original plate to which ink is applied, wherein the printing blanket is formed of an elastic material and has a shape having a flat top surface and narrowed toward an end portion on a bottom surface, transferring the ink to the printing blanket, and pressing the printing blanket to which the ink has been transferred against a printing medium thereby printing, with the ink, the printing medium, the printing medium including flat portion opposing the printing blanket and an annular protruding portion smoothly extending from a periphery of the flat portion, wherein the step of transferring the ink includes:

causing the top of the printing blanket to descend at a lowest velocity in an initial stage of contact between the end portion of the printing blanket and the flat portion of the printing medium, increasing the velocity of descent of the top surface of the printing blanket as the printing blanket is pressed further against the printing medium after the initial stage of contact between the end portion of the printing blanket and the periphery of the hole, and reducing a velocity of descent of the printing blanket when a curvature radius of a predetermined position on a lateral face of the printing blanket becomes close to a curvature radius of a position of the printing medium against which the predetermined position is pressed.

9. The printing method of claim 8, wherein the curvature radius (Rb) of the position of the lateral face of the printing blanket pressed against the printing medium is larger than a half of the curvature radius (Rp) of the position of the printing medium against which the lateral face of the printing blanket is pressed, and is smaller than the curvature radius (Rp) ($Rp/2<Rb<Rp$).

10. The printing method of claim 8, further comprising: reducing the velocity of descent of the printing blanket to 10% to 15% of a velocity of ascent of the printing blanket being separated from the printing medium; and increasing the velocity of descent to 50% to 60% of the velocity of ascent of the printing blanket being separated from the printing medium.

* * * * *